US007913724B2

(12) United States Patent
Pansegrouw

(10) Patent No.: US 7,913,724 B2
(45) Date of Patent: Mar. 29, 2011

(54) INFLATION DEVICE

(75) Inventor: Bester Jacobus Pansegrouw, Ottery (ZA)

(73) Assignee: Stopak (Pty) Ltd., Ottery (SA)

( * ) Notice: Subject to any disclaimer, the term of this patent is extended or adjusted under 35 U.S.C. 154(b) by 0 days.

(21) Appl. No.: 12/548,818

(22) Filed: Aug. 27, 2009

(65) Prior Publication Data

US 2010/0006176 A1 Jan. 14, 2010

Related U.S. Application Data

(63) Continuation of application No. PCT/IB2009/050851, filed on Mar. 3, 2009.

(30) Foreign Application Priority Data

Mar. 4, 2008 (ZA) ..... 08/2055

(51) Int. Cl.
*B65B 1/30* (2006.01)

(52) U.S. Cl. ..... 141/197; 141/10; 141/301; 141/346; 137/223

(58) Field of Classification Search ..... 141/2, 10, 141/67, 94, 95, 98, 114, 197, 301, 346, 347; 137/223; 239/265.11
See application file for complete search history.

(56) References Cited

U.S. PATENT DOCUMENTS

| | | | | |
|---|---|---|---|---|
| 2,859,908 | A | 11/1958 | Neigel | |
| 3,591,314 | A | 7/1971 | Day | |
| 5,180,456 | A | 1/1993 | Schultz et al. | |
| 5,454,407 | A * | 10/1995 | Huza et al. | 141/10 |
| 5,566,728 | A * | 10/1996 | Lange | 141/10 |
| 5,579,999 | A | 12/1996 | Seiner et al. | |
| 5,806,572 | A * | 9/1998 | Voller | 141/10 |
| 5,829,492 | A * | 11/1998 | Gavronsky et al. | 141/96 |
| 6,253,806 | B1 | 7/2001 | Sperry et al. | |
| 7,320,347 | B2 * | 1/2008 | Ramsey et al. | 141/285 |
| 7,455,086 | B1 * | 11/2008 | Elze et al. | 141/388 |
| 7,610,929 | B2 * | 11/2009 | Zielinski et al. | 137/223 |

OTHER PUBLICATIONS

International Search Report and Written Opinion of PCT/IB2009/050851 mailed May 20, 2009.

* cited by examiner

*Primary Examiner* — Timothy L Maust
(74) *Attorney, Agent, or Firm* — Summa, Additon & Ashe, P.A.

(57) ABSTRACT

An inflation device for inflating containers with non-rigid walls such as bags, which includes a body having a venturi shaped air channel. First and second air inlets lead into the air channel, with an outlet being adapted to allow air to exit from the air channel for inflating a container when joined to the outlet. The second inlet is adapted to be closed by a self-closing valve if air does not flow through the air channel. A sensor associated with the body is adapted to detect when a container, such as a bag, joined to the body has been filled to a predetermined degree and then causes the flow of air through the air channel to be interrupted.

20 Claims, 11 Drawing Sheets

INFLATION DEVICE

CROSS-REFERENCE TO PRIORITY APPLICATIONS

This application is a continuation of and hereby claims the benefit of the commonly assigned South African Patent Application Serial No. ZA2008/02055 (filed Mar. 4, 2008), and the commonly assigned International Patent Application No. PCT/IB2009/050851 (filed Mar. 3, 2009), both of which are hereby incorporated by reference in their entirety.

FIELD OF THE INVENTION

The present invention relates to an inflation device. More particularly, the invention relates to an inflation device for inflating containers with non-rigid walls, such as dunnage bags.

BACKGROUND

Inflatable dunnage bags are commonly used for cushioning loads shipped in trucks, trailers and containers transported by ships, trucks or rail. This is often the case when the cargo only partially fills the container and there exists the possibility of shifting during transport that could cause damage. Typically known dunnage bags are constructed of one or more layers of paper or woven polypropylene surrounding a plastic lining. The paper protects the bags from tearing—thus more layers are used in applications where the risk of damage to the dunnage bag is greater. Furthermore, for inflating and deflating the dunnage bag, a valve is attached by way of a hole cut in the bag during manufacture.

The dunnage bags are shipped flat from the manufacturer, and are inflated by packing and loading personnel as the containers are loaded with cargo. The bag is firstly placed in the space that it will occupy as cargo is loaded into a container, secondly the inflation device is attached to a valve of the dunnage bag and subsequently the dunnage bag is filled with air until an appropriate air pressure within the bag is achieved. Typically this occurs within a few seconds.

Various types of inflation devices exist for inflating containers with non-rigid walls and air-filled bags, such as sacks and dunnage bags commonly used to cushion cargo loads. Known inflation devices include tire inflation tools which have been converted or adapted and are attached to a hose leading from a source of compressed air. Some inflation devices incorporate venturi tubes and are often known as venturi air-flow guns, which include a venturi tube, namely an air passage with a region of restricted diameter. In terms of Bernoulli's law (i.e. the inverse relationship between air velocity and pressure), passage of air through the restricted region of a venturi tube creates a low-pressure region resulting in a suction effect used to draw air out of an attached container.

Unfortunately the known type of inflation devices are difficult to operate and not flexible in operation and thus suffer from important limitations. Furthermore in practice it must be ensured that an inflated bag is fully inflated.

It is an object of the invention to suggest an inflation device which will assist in overcoming the aforesaid problems.

SUMMARY OF THE INVENTION

According to the invention, an inflation device for inflating containers with non-rigid walls such as bags, includes:

(a) a body;

(b)an air channel provided in the body and having opposite first and second open ends;

(c) a venturi tube in the body and being in communication with the first and second open ends of the air channel;

(d) a first inlet in the body and being in communication with the air channel and the venturi tube and being adapted to allow compressed air to enter the venturi tube via the air channel to the second open end;

(e) an outlet in the body and being in communication with the second open end of the air channel via the venturi tube and being adapted to allow air to exit from the venturi tube for inflating a container when joined to the outlet;

(f) a second inlet in the body and being in communication with the first open end of the air channel and being adapted to allow ambient air to be sucked or drawn into the venturi tube as a result of compressed air entering the air channel and passing through the venturi tube;

(g) a first self-closing valve located at the second inlet in the body and being adapted to close off the second inlet if air is not sucked into the air channel; and (h) a sensor means associated with the body and being adapted to detect when a container, such as a bag, joined to the body has been filled to a predetermined degree and being adapted then to cause the supply of compressed air into the air channel to be interrupted.

Also according to the invention, an inflation device for inflating containers with non-rigid walls, includes:

(a) a body;

(b) an air channel provided in the body and having opposite first and second open ends;

(c) a venturi tube in the body and being in communication with the first and second open ends of the air channel;

(d) a first inlet in the body and being in communication with the air channel and the venturi tube and being adapted to allow compressed air to enter the venturi tube via the air channel to its second open end;

(e) an outlet in the body and being in communication with the second open end of the air channel via the venturi tube and being adapted to allow air to exit from the venturi tube for inflating a container when joined to the outlet;

(f) a second inlet in the body and being in communication with the air channel and being adapted to allow ambient air to be sucked into the venturi tube as a result of compressed air entering the air channel and passing through the venturi tube;

(g) a first self-closing valve located at the second inlet in the body and being adapted to close off the second inlet if air is not sucked into the air channel;

(h) a pressure relieve valve in the container, such as a bag, and being in communication with the air channel; and (i) a sensor means associated with the body and being adapted to detect when a container, such as a bag, joined to the body has been filled to a predetermined degree and being adapted then to cause the supply of compressed air into the air channel to be interrupted.

Yet further according to the invention, there is provided a method of inflating containers with non-rigid walls, such as bags, including the steps of:

joining the outlet of an inflation device as set out herein to the inlet of a container to be inflated;

allowing compressed air to enter the first inlet for inflating the container; and removing the container when the compressed air supply has been interrupted by the sensor means.

The inflation device may also be used to deflate the containers, for which purpose the device includes a deflating valve.

The inflation device may be a venturi-air flow apparatus or gun.

The venturi tube may include a supersonic nozzle.

In use the air exiting the outlet may have an absolute pressure of about 9 bar.

In use the compressed air entering the air channel may have a pressure of 9 bar absolute.

The supersonic nozzle may be a shock-free type.

The inflation device may be used as a high volume inflator operating at low pressure. For example, the inflation device may operate at a flow rate of between about 40 and 50 liters per minute.

In use the operating pressure of the inflation device may be about 9 bar absolute.

The body may have a flange for securing the inflation device to the container.

The container may be a dunnage bag, a sack and/or any other flexible container to be pressurized.

The body may include threads suitable for cooperating with complementary threads of a container's inlet.

The device may include a valve connector assembly attached to the outlet of the air channel, which is adapted to be releaseably engaged to a valve.

The venturi tube may include a frustoconical bore.

The first inlet may be adapted to receive an air hose for supplying compressed air.

The first inlet may include a second self-closing valve.

The second self-closing valve may be adapted to automatically close off the first inlet.

The first closing valve and the second closing valve may include a spring adapted to assist the valves in closing the respective openings.

BRIEF DESCRIPTION OF THE DRAWINGS

The foregoing and other objects and advantages of the invention and the manner in which the same are accomplished will become clearer based on the following detailed description taken in conjunction with the accompanying drawings in which.

DETAILED DESCRIPTION

Figure 1:
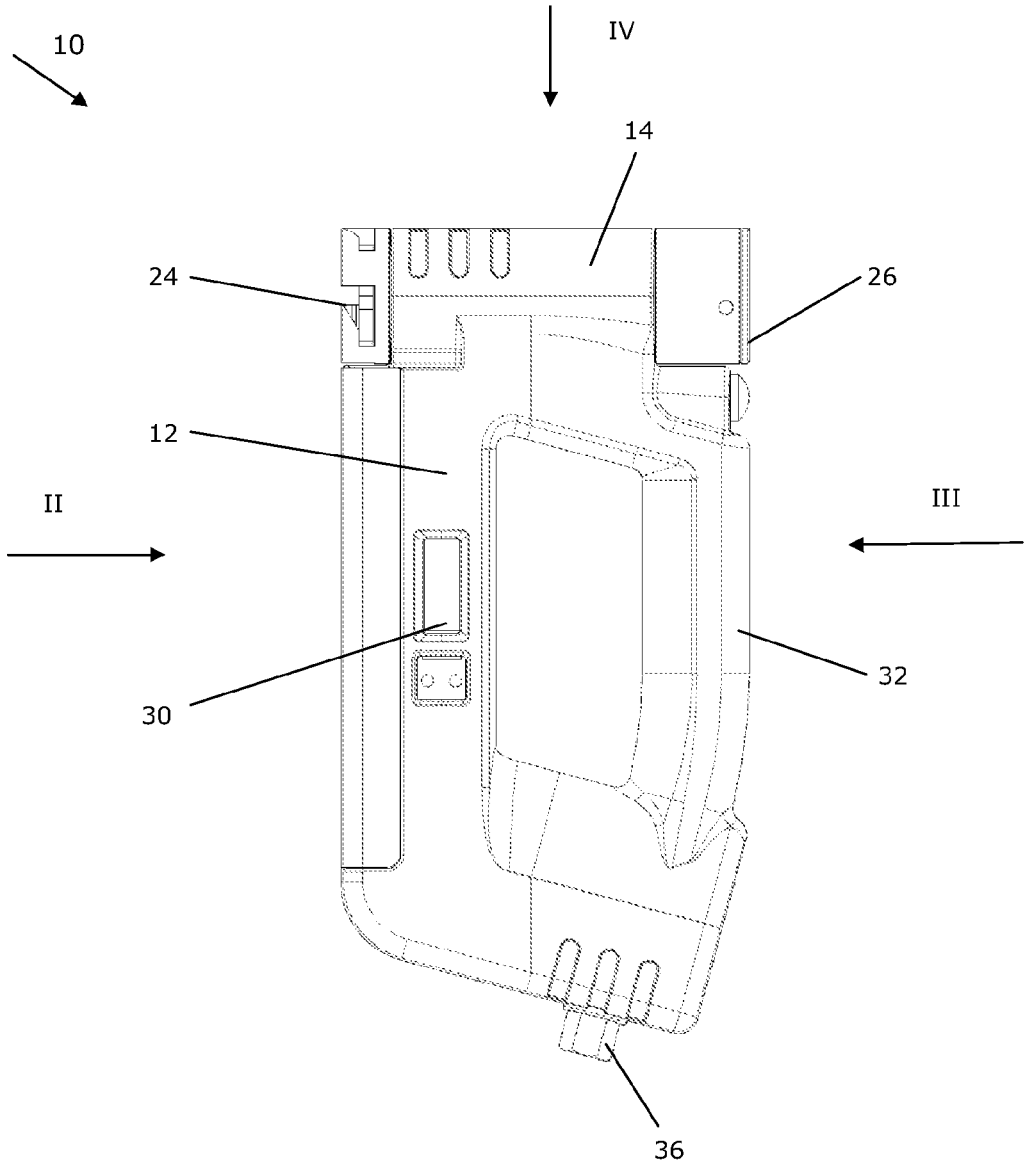
FIG. 1 is a side view of an inflation device in accordance with one embodiment of the invention.
Figure 2:
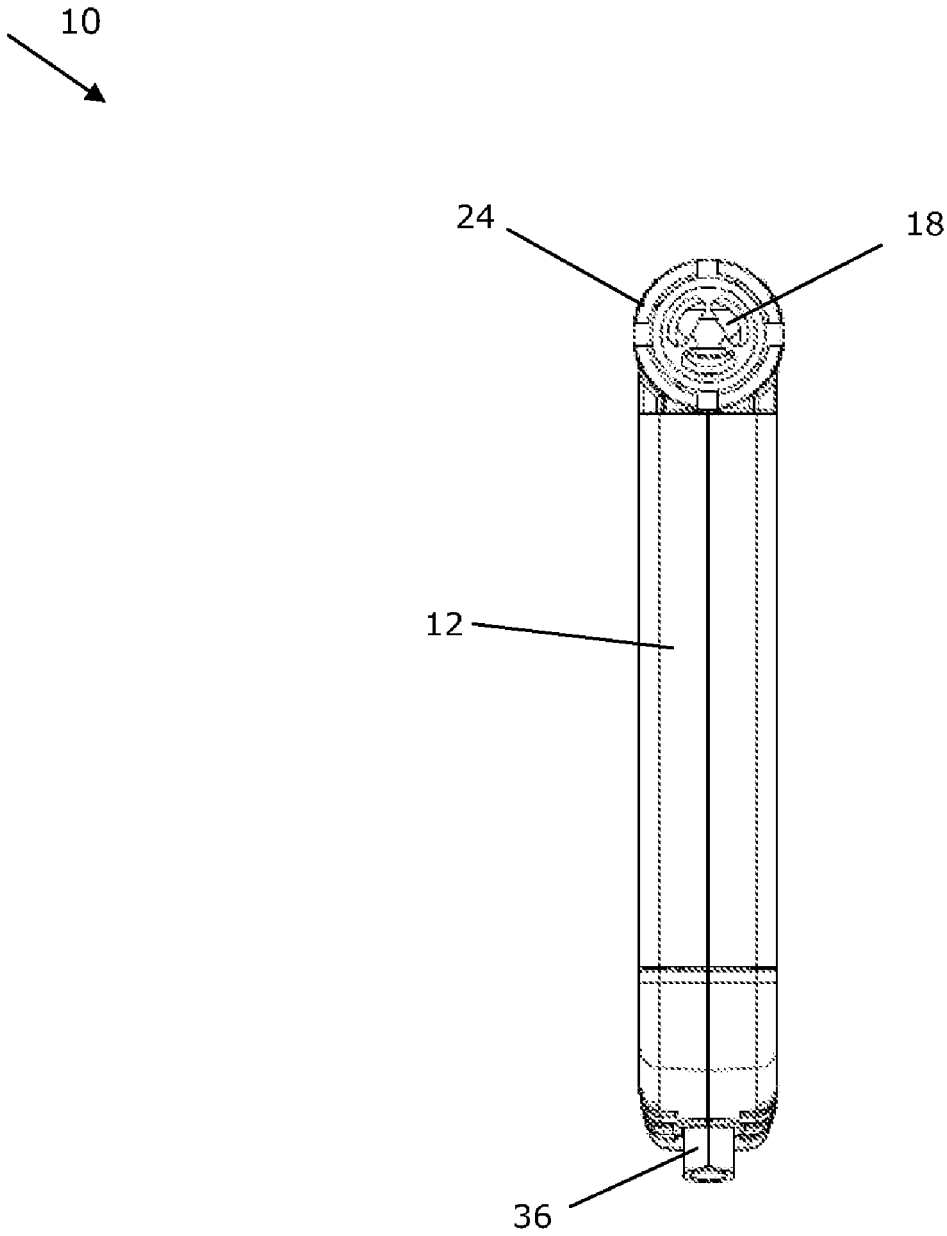
FIG. 2 is a front view of the inflation device as seen from arrow II in FIG. 1.
Figure 3:
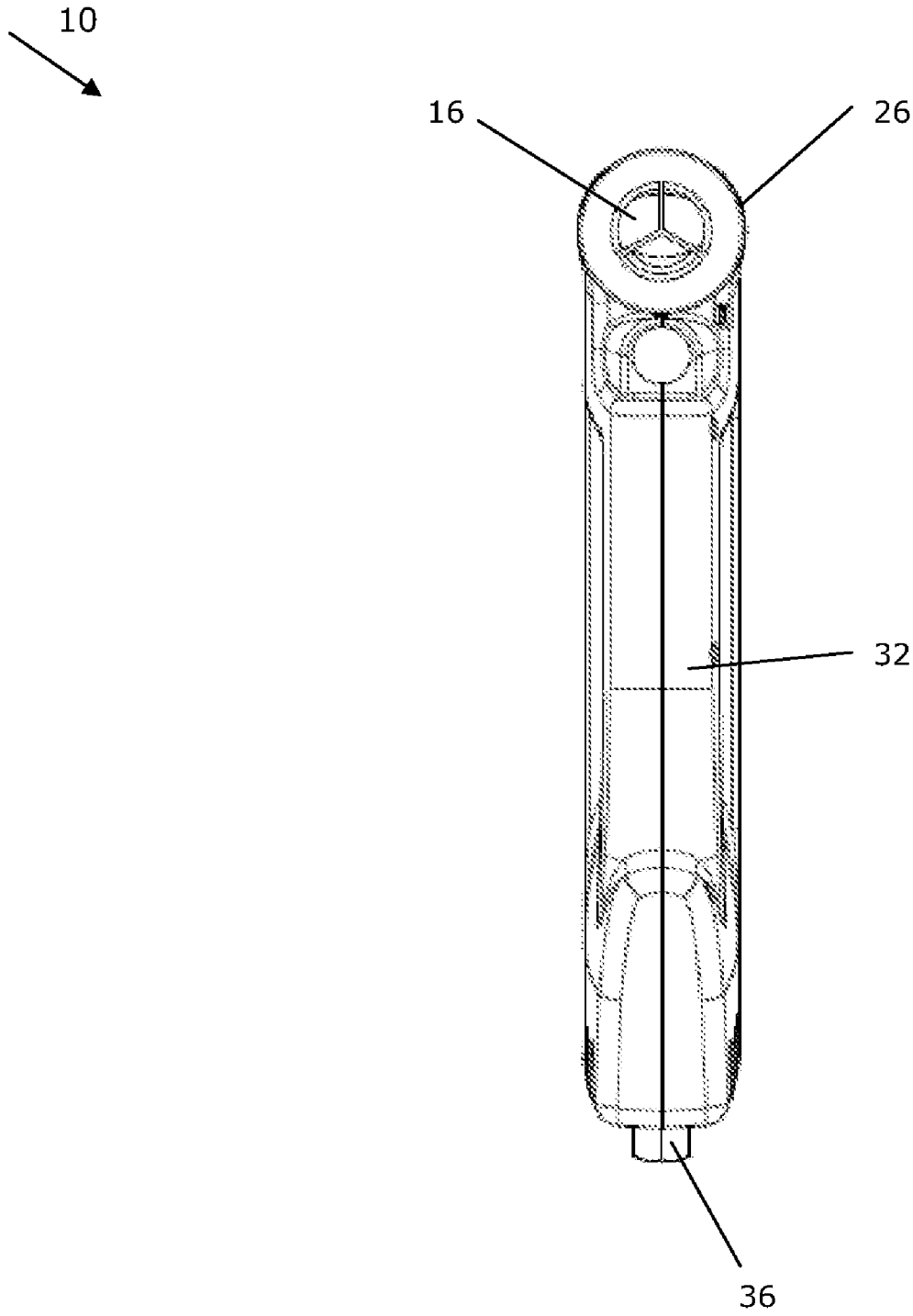
FIG. 3 is a rear view of the inflation device as seen from arrow III in FIG. 1.
Figure 4:
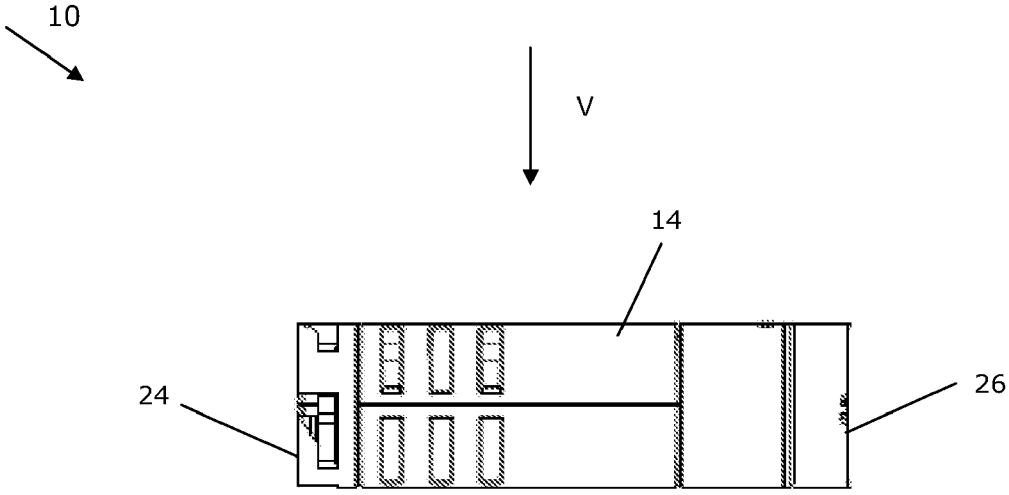
FIG. 4 is a top view of the inflation device as seen from arrow IV in FIG. 1.
Figure 5:
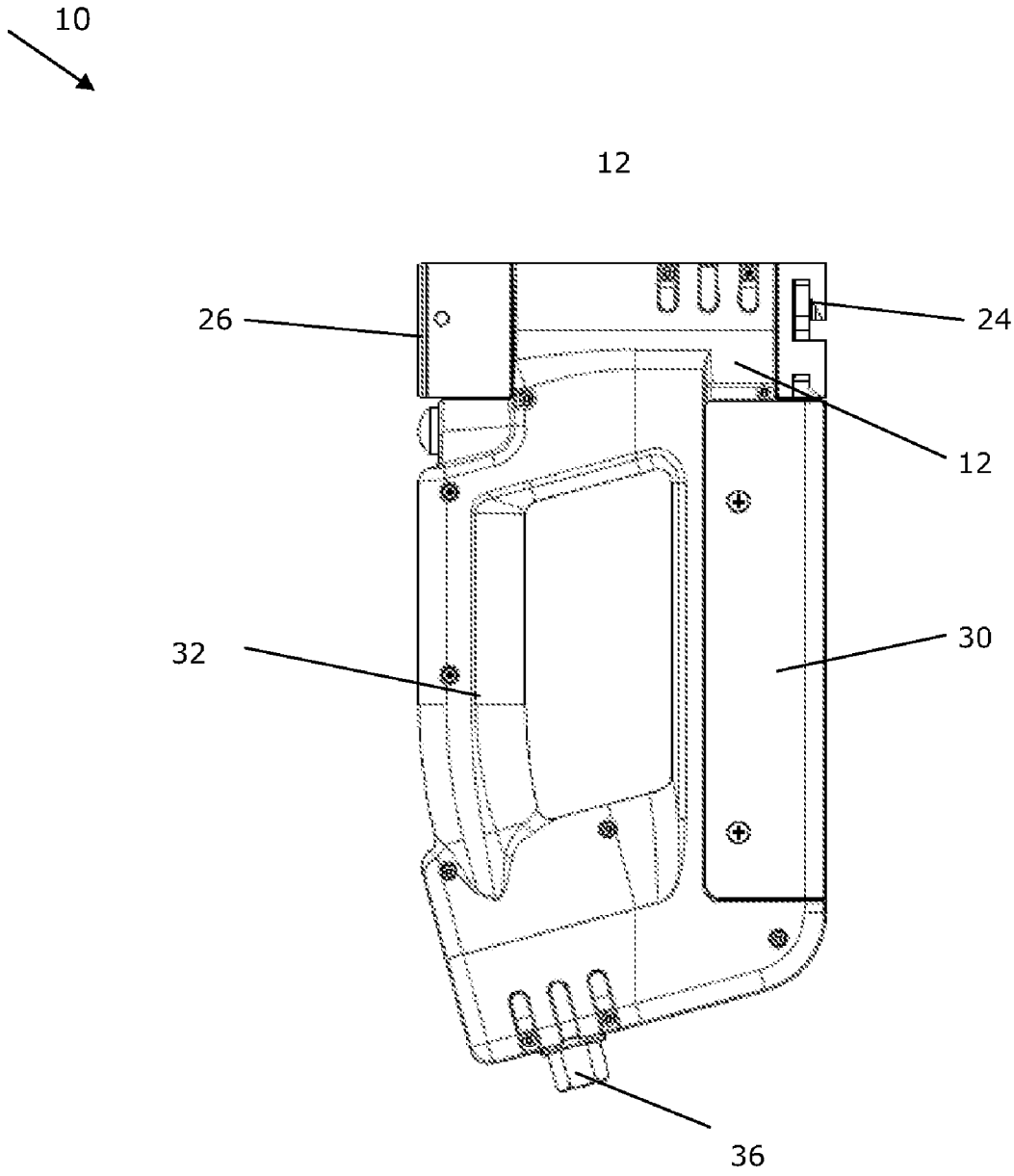
FIG. 5 is a second side view of the inflation device as seen from arrow V in FIG. 2.
Figure 6:
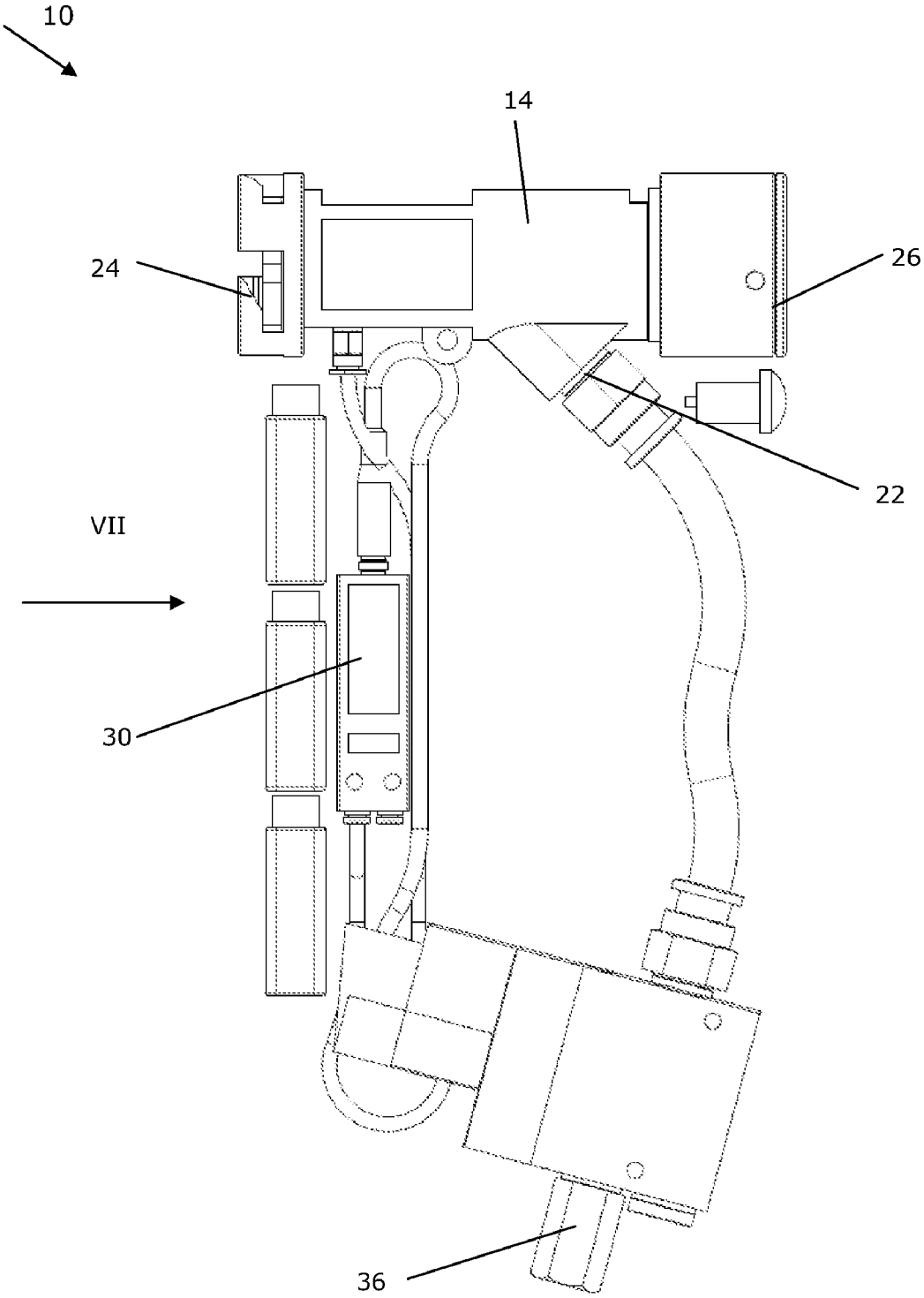
FIG. 6 is a side view of the internal components of the inflation device as shown in FIG. 1.
Figure 7:
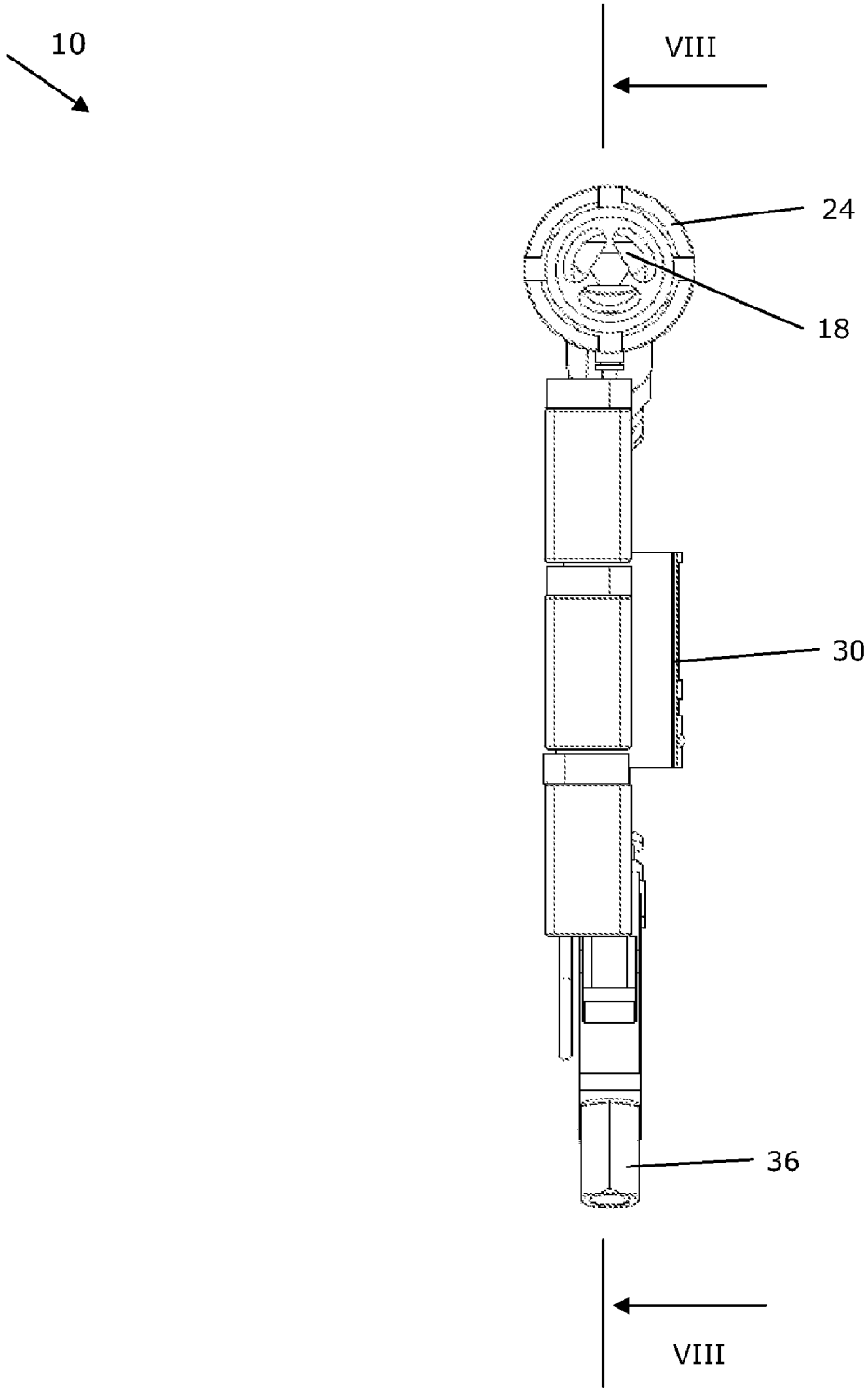
FIG. 7 is a front view of the internal components of the inflation device as seen from arrow VII in FIG. 6.
Figure 8:
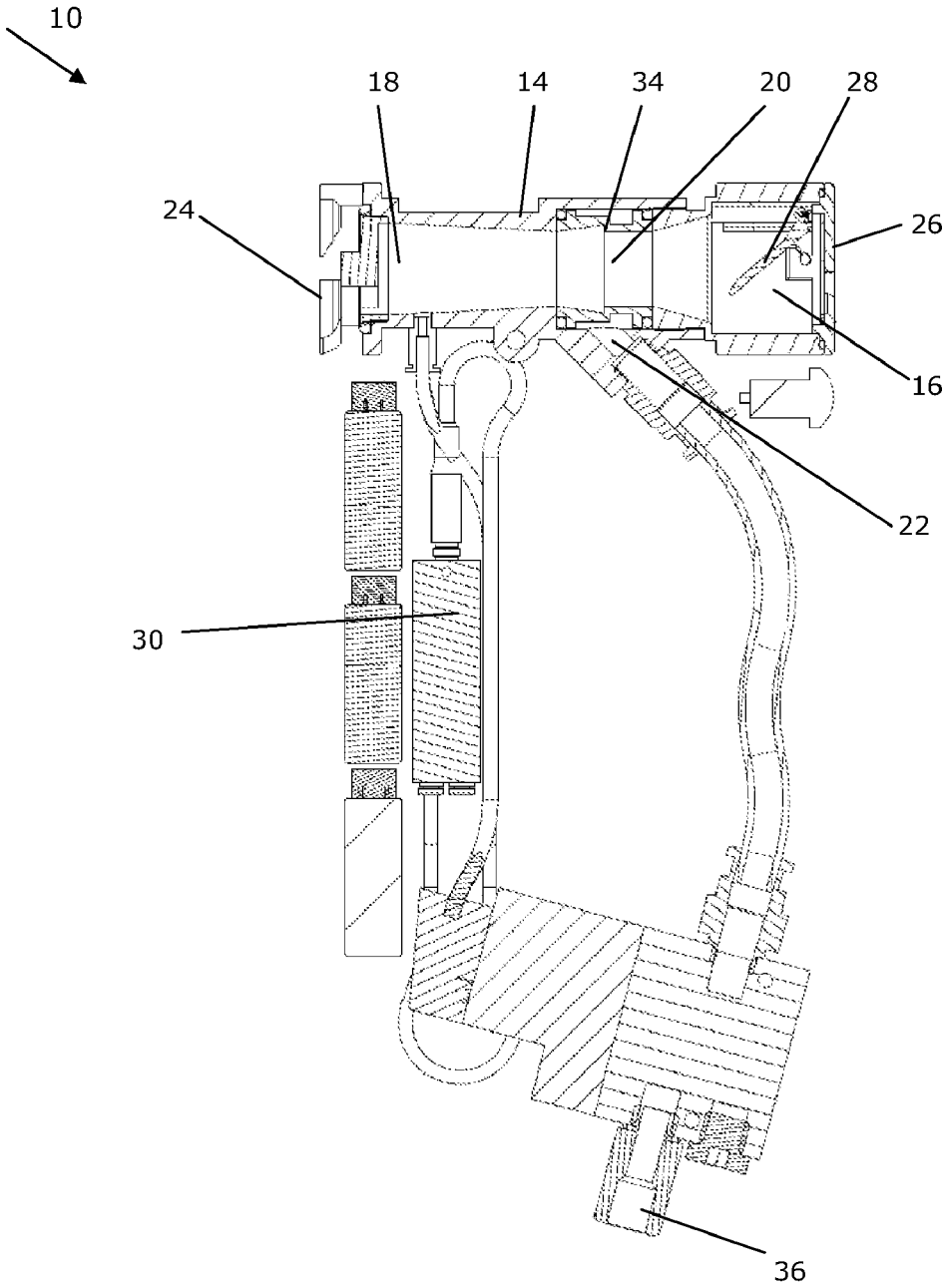
FIG. 8 is a sectional side view of the internal components of the inflation device as seen from arrows VIII-VIII in FIG. 7.
Figure 9:
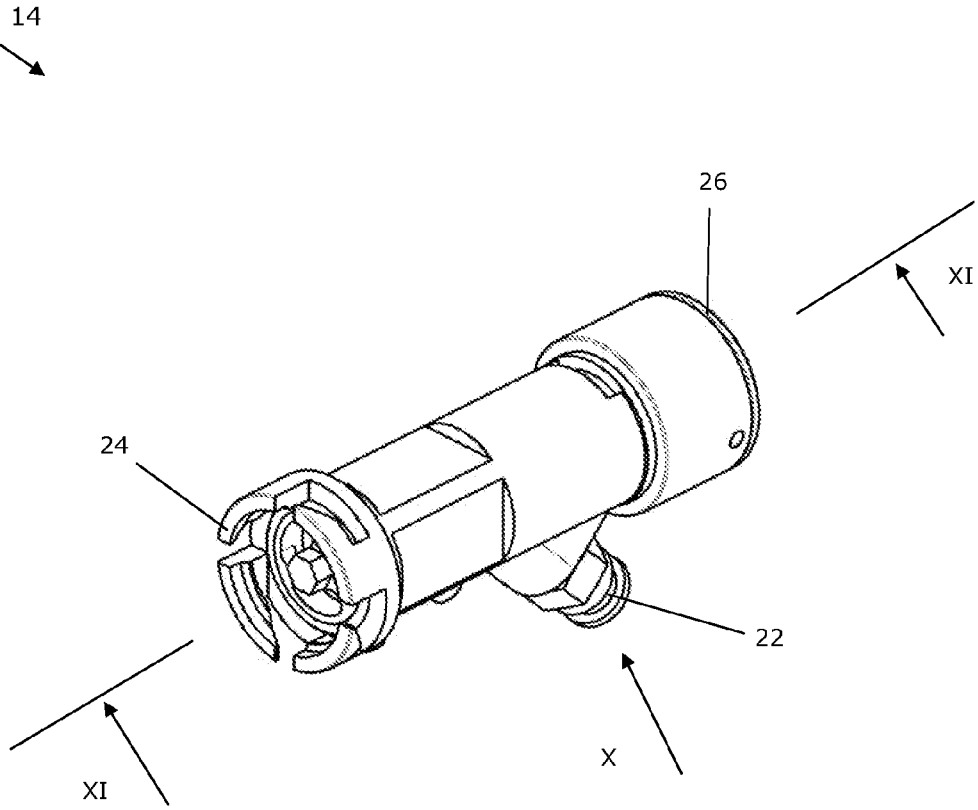
FIG. 9 is a perspective view of the air channel of the inflation device as shown in FIG. 1.
Figure 10:
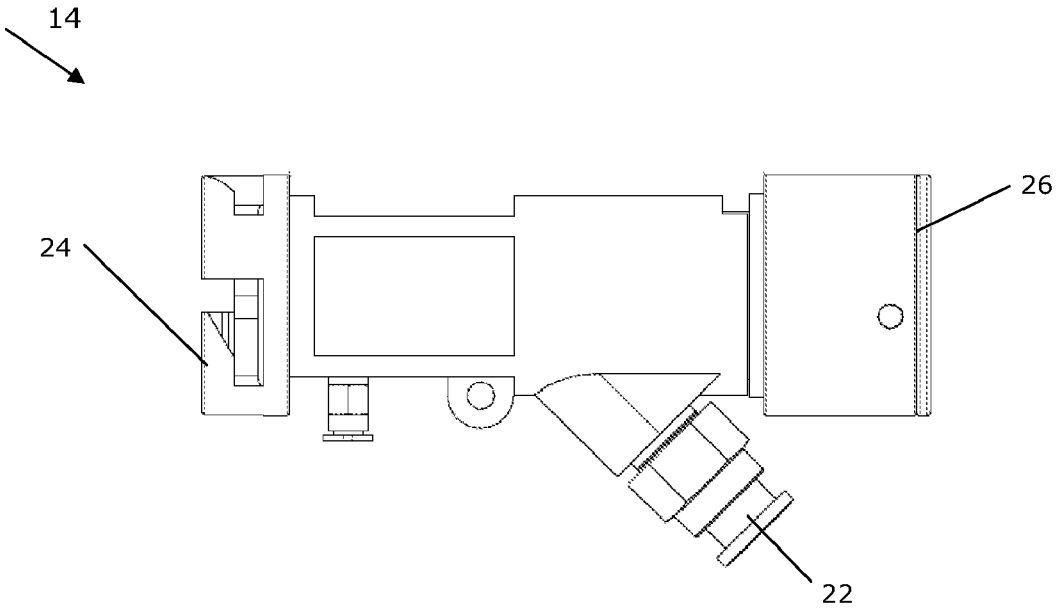
FIG. 10 is a side view of the air channel of the inflation device as seen from arrow X in FIG. 9.
Figure 11:
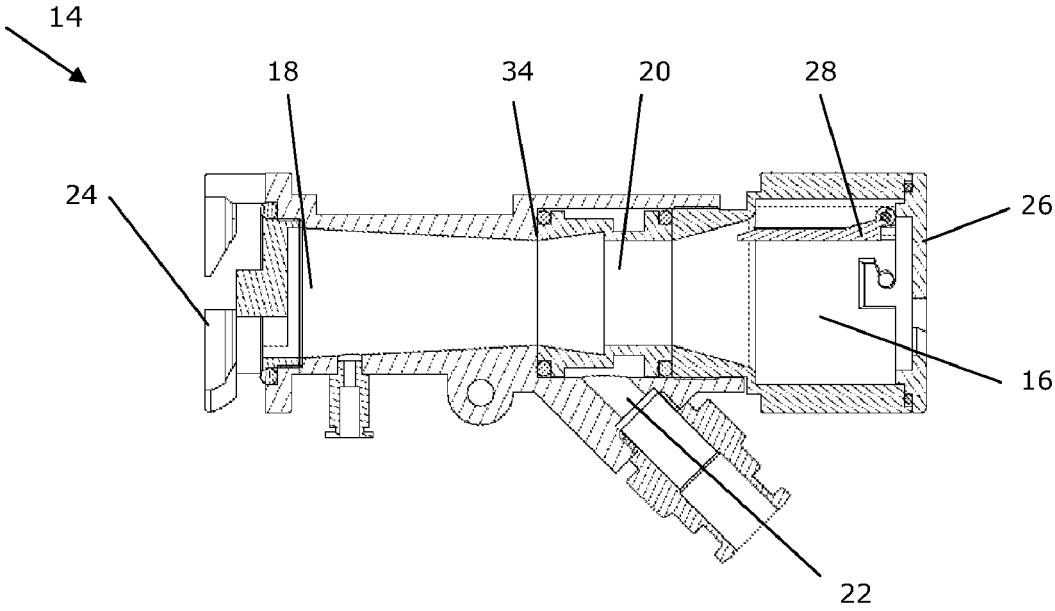
FIG. 11 is a sectional side view of the air channel of the inflation device as seen from arrows XI-XI in FIG. 9.

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring to the drawings, an inflation device in accordance with the invention, generally indicated by reference numeral 10, is shown.

The inflation device 10 is intended for inflating containers with non-rigid walls such as bags.

The inflation device 10 includes:

(a) a body 12;

(b) an air channel 14 provided in the body and having opposite open ends 16 and 18;

(c) a venturi tube 20 in the air channel 14 and being in communication with the first open end 16 and second open end 18 of the air channel 14;

(d) a first inlet 22 in the body 12 and being in communication with the air channel 14 and the venturi tube 20 and being adapted to allow compressed air to enter the venturi tube 20;

(e) an outlet 24 in the body 12 and being in communication with the open end 18 of the air channel 14 and being adapted to allow air to exit from the air channel 14 and venturi tube 20 for inflating a container when joined to the outlet 24;

(f) a second inlet 26 in the body 12 and being in communication with the air channel 14 and being adapted to allow ambient air to be sucked into the venturi tube 20 as a result of compressed air entering the air channel 14 and passing through the venturi tube 20;

(g)a first self-closing valve 28 located at the second inlet 26 in the body 12 and being adapted to close off the second inlet 26 if air is not sucked into the air channel 14; and (h) a sensor means 30 associated with the body 12 and being adapted to detect when a container, such as a bag, joined to the body 12 has been filled to a predetermined degree and being adapted then to cause the supply of compressed air into the air channel 14 to be interrupted.

The body 12 furthermore has a handle 32 for suitably gripping and holding the inflation device 10 during filling of a bag.

The inflation device 10 can also be used to deflate containers by means of a deflating valve.

The inflation device 10 is typically in the form of a venturi-air flow apparatus or gun.

The venturi tube 20 includes a supersonic nozzle 34, which is of a shock-free type.

In use the air exiting the outlet 24 can have an absolute pressure of about 9 bar.

In use the compressed air entering the air inlet 22 can have a pressure of about 9 bar absolute.

The outlet 24 is adapted to be releasably engaged to an inlet valve of a container to be inflated.

The fitting 36 connected to the first inlet 22 is adapted to be coupled to an air hose. It is also provided with a second self-closing valve. This second self-closing valve is adapted to automatically close off or seal the first inlet 22, for example, when caused to do so by the sensor means 30.

The venturi tube 20 has a first self-closing valve 28 at the second inlet 26 including a spring adapted to assist in closing the inlet 26 to the venturi tube 20.

The second self-closing valve includes a spring adapted to assist in closing the first inlet 22.

In one embodiment the container to be inflated can be a dunnage bag, a sack, or any number of flexible containers configured for inflation under pressure. The container is generally provided with a valve having a flange for securing the outlet 24 to the container. The valve is generally a one-way or semi-one-way valve.

The inflation device 10 in accordance with the invention can be used as a high volume inflator operating at low pressure for inflating containers having non-rigid walls. In one embodiment, the operating pressure of the inflation device 10 is about 9 bar absolute.

A pressure relieve valve is provided in the container to be inflated, such as a bag, and being in communication with the air channel.

The air channel 14 may also be provided with a pressure relief valve.

In another embodiment, the inflation device 10 in accordance with the invention, thus provides a method of inflating containers with non-rigid walls, which includes the steps of:

(a) coupling the fitting 36 to a compressed air supply tube;

(b) coupling the outlet 24 to a bag to be inflated;

(c) allowing compressed air to enter through a first inlet 22;

(d) allowing air to be sucked through the second inlet 26 into the venturi tube 20, as a result of the compressed air entering the air channel 14; and (e) removing a bag when the compressed air supply has been interrupted by the sensor means 30 on reaching a predetermined filling degree in the bag.

The sensor means 30 can be adjusted to cause interruption of the compressed air supply depending on the degree of inflation of the bag required, for example when the bag is full under a pressure or about 9 bar.

In the drawings and specification, there have been disclosed typical embodiments on the invention and, although specific terms have been employed, they have been used in a generic and descriptive sense only and not for purposes of limitation, the scope of the invention being set forth in the following claims.

The invention claimed is:

1. An inflation device for inflating containers with non-rigid walls, the inflation device comprising:

a body;

an air channel provided in the body and having opposite first and second open ends;

a venturi tube positioned in the body and being in communication with the first and second open ends of the air channel;

a first inlet in the body and being in communication with the air channel and the venturi tube, the first inlet configured to allow compressed air to enter the venturi tube via the air channel and advance to the second open end;

an outlet in the body and being in communication with the second open end of the air channel via the venturi tube, the outlet configured to allow air to exit from the venturi tube such that the air inflates a container when the container is joined to the outlet;

a second inlet in the body and being in communication with the first open end of the air channel, the second inlet configured to allow ambient air to be sucked into the venturi tube as a result of compressed air entering the air channel and passing through the venturi tube;

a first self-closing valve located at the second inlet in the body, the first self-closing valve configured to close off the second inlet if air is not sucked into the air channel;

a sensor means associated with the body and configured to detect when a container joined to the body has been filled with air to a predetermined degree, the sensor means configured to interrupt the supply of compressed air entering the channel upon achieving the predetermined level; and a deflating valve positioned in the body;

wherein the device is configured to deflate the container.

2. A device as claimed in claim 1, further comprising a pressure relief valve in communication with the air channel.

3. A device as claimed in claim 1, wherein the device is selected from the group consisting of a venturi-air flow apparatus and a gun.

4. A device as claimed in claim 3, wherein the venturi tube comprises a supersonic nozzle.

5. A device as claimed in claim 4, wherein the supersonic nozzle is a shock-free nozzle.

6. A device as claimed in claim 1, wherein the air exiting the outlet has an absolute pressure of about 9 bar during use.

7. A device as claimed in claim 1, wherein the compressed air entering the air channel has a pressure of 9 bar absolute during use.

8. A device as claimed in claim 1, wherein the device is a high volume inflator operating at low pressure.

9. A device as claimed in claim 1, wherein the flow rate of the inflation device is between about 40 and 50 liters per minute.

10. A device as claimed in claim 1, wherein the operating pressure of the inflation device is about 9 bar absolute during use.

11. A device as claimed in claim 1, wherein the body has a flange for securing the inflation device to the container.

12. A device as claimed in claim 1, wherein the container is selected from the group consisting of a dunnage bag, a sack and any other flexible container to be pressurized.

13. A device as claimed in claim 1, wherein the body includes threads suitable for cooperating with complementary threads of the container's inlet.

14. A device as claimed in claim 1, further comprising a valve connector assembly attached to the outlet of the air channel, the valve connector assembly configured to releasably engage a valve.

15. A device as claimed in claim 1, wherein the venturi tube comprises a frustoconical bore.

16. A device as claimed in claim 1, wherein the first inlet is configured to receive an air hose for supplying compressed air.

17. A device as claimed in claim 1, wherein the first inlet comprises a second self-closing valve.

18. A device as claimed in claim 17, wherein the second self-closing valve is configured to automatically close off the first inlet.

19. A device as claimed in claim 17, wherein the first closing valve and the second closing valve include a spring configured to assist the valves in closing the respective openings.

20. A method of inflating containers with non-rigid walls, wherein the method comprises the steps of:

joining the outlet of an inflation device as claimed in claim 1 to an inlet of a container to be inflated;

allowing compressed air to enter the first inlet for inflating the container; and removing the container when the compressed air supply has been interrupted by the sensor means.

* * * * *